US005901951A

United States Patent [19]

Yamaguchi

[11] Patent Number: 5,901,951

[45] Date of Patent: May 11, 1999

[54] SHEET SUPPLYING APPARATUS

[75] Inventor: Takeshi Yamaguchi, Kawasaki, Japan

[73] Assignee: Canon Kabushiki Kaisha, Tokyo, Japan

[21] Appl. No.: 08/805,747

[22] Filed: Feb. 25, 1997

[30] Foreign Application Priority Data

Feb. 29, 1996 [JP] Japan ..... 8-069432
Jul. 25, 1996 [JP] Japan ..... 8-195911

[51] Int. Cl.[6] ..... B65H 5/00

[52] U.S. Cl. ..... 271/10.11; 271/9.09; 271/122

[58] Field of Search ..... 271/10.11, 4.1, 271/10.05, 10.04, 122, 9.09

[56] References Cited

U.S. PATENT DOCUMENTS 5,449,162 9/1995 Saito et al. .
5,470,052 11/1995 Asakawa et al. ..... 271/122
5,571,265 11/1996 Yagi et al. ..... 271/122
5,678,817 10/1997 Saito et al. ..... 271/122
5,755,435 5/1998 Fujiwara ..... 271/10.05

FOREIGN PATENT DOCUMENTS 57-72543 5/1982 Japan .
357090337 6/1982 Japan ..... 271/9.09
0167836 8/1985 Japan ..... 271/122
0139842 6/1988 Japan ..... 271/122

*Primary Examiner*—H. Grant Skaggs
*Attorney, Agent, or Firm*—Fitzpatrick, Cella, Harper & Scinto

[57] ABSTRACT

The present invention provides a sheet supplying apparatus comprising a sheet supporting means for supporting a sheet, a sheet supply means for feeding out the sheet supported by the sheet supporting means, a separation means disposed downstream of the sheet supply means in a sheet supplying direction and including a normal rotation member rotated in the sheet supplying direction and a reverse rotation member rotated in a reverse direction opposite thereby to separate the sheets fed out by the sheet supply means one by one, and a drive force transmission switching means for transmitting a rotational force to the reverse rotation member to rotate the reverse rotation member in the reverse direction when the sheets supported by the sheet supporting means are fed out continuously, and for stopping the transmission of the rotational force to the reverse rotation member when a single sheet is inserted into the separation means.

16 Claims, 5 Drawing Sheets

SHEET SUPPLYING APPARATUS

BACKGROUND OF THE INVENTION

1. Field of the Invention

The present invention relates to a sheet supplying apparatus for supplying a sheet, an image reading apparatus utilizing such a sheet supplying apparatus to supply a sheet original to a reading portion, and an image recording apparatus utilizing such a sheet supplying apparatus to supply a sheet to a recording portion.

2. Related Background Art

There has been proposed a sheet supplying apparatus comprising a sheet stacking portion on which sheets are stacked, a supply roller for supplying the sheets stacked on the sheet stacking portion, a feed roller disposed at a downstream side of the supply roller and rotated in a normal direction with respect to a sheet supplying direction, and a reverse rotation roller capable of being urged against the feed roller and rotated in a reverse direction. Further, it is also known to provide a sheet supplying apparatus including a continuous supply mode for continuously supplying sheets stacked on a sheet stacking portion and manual sheet insertion mode for supplying a sheet rested on the sheet stacking portion one by one.

In the continuous supply mode, the sheets stacked on the sheet stacking portion are successively supplied between the downstream feed roller and reverse rotation roller by the supply roller, where lower sheets other than an uppermost sheet among double-fed sheets are returned toward an upstream direction by the reverse rotation roller, and only the uppermost sheet contacted with the feed roller is separated from the other sheets and is conveyed toward a downstream direction.

On the other hand, in the manual sheet insertion mode, as is in the continuous supply mode, when the sheet is supplied between the feed roller and the reverse rotation roller, if the sheet has poor resiliency (such as a thin sheet), a tip end of the sheet will be entrained by the reverse rotation roller or winkles are apt to be formed in the sheet. Further, when a folded sheet is supplied, since the reverse rotation roller tries to separate a lower folded portion of the sheet from an upper folded portion of the sheet, thereby causing the sheet jam. Thus, to avoid such an inconvenience, the reverse rotation roller is separated from the feed roller so that the sheet is supplied toward the downstream direction by the feed roller alone.

However, in the manual sheet insertion mode, when the reverse rotation roller is separated from the feed roller, although the entrainment of the sheet on the reverse rotation roller and the formation of the wrinkles can be prevented, a contacting force between the feed roller and the sheet becomes small, a conveying force acting on the sheet frequently becomes insufficient.

SUMMARY OF THE INVENTION

The present invention intends to eliminate the above-mentioned conventional drawbacks, and has an object to provide a sheet supplying apparatus, and an image reading apparatus and an image forming apparatus utilizing such a sheet supplying apparatus, in which, even in a manual sheet insertion mode, a sheet can be supplied positively.

To achieve the above object, the present invention provides a sheet supplying apparatus comprising a sheet supporting means for supporting a sheet, a sheet supply means for feeding out the sheet supported by the sheet supporting means, a separation means disposed downstream of the sheet supply means in a sheet supplying direction and including a normal rotation member rotated in the sheet supplying direction and a reverse rotation member rotated in a reverse direction opposite thereto to separate the sheets fed out by the sheet supply means one by one, and a drive force transmission switching means for transmitting a rotational force to the reverse rotation member to rotate the reverse rotation member in the reverse direction when the sheets supported by the sheet supporting means are fed out continuously, and for stopping the transmission of the rotational force to the reverse rotation member when a single sheet is inserted into the separation means.

According to another aspect of the present invention, there is provided a sheet supplying apparatus comprising a sheet supporting means for supporting a sheet, a sheet supply means for feeding out the sheet supported by the sheet supporting means, a separation means disposed downstream of the sheet supply means in a sheet supplying direction and including a normal rotation member rotated in the sheet supplying direction and a reverse rotation member rotated in a reverse direction opposite thereto to separate the sheets fed out by the sheet supply means one by one, and a drive force transmission switching means for transmitting a rotational force to the reverse rotation member to rotate the reverse rotation member in the reverse direction when the sheets supported by the sheet supporting means are fed out continuously, and for transmitting a rotational force to the reverse rotation member to rotate the reverse rotation member in the sheet supplying direction when a single sheet is inserted into the separation means.

BRIEF DESCRIPTION OF THE DRAWINGS

FIG. 1A shows a continuous sheet supply mode, and FIG. 1B shows a manual sheet insertion mode;

FIG. 3A shows a continuous sheet supply mode and FIG. 3B shows a manual sheet insertion mode;

DETAILED DESCRIPTION OF THE PREFERRED EMBODIMENTS

The present invention will now be explained with reference to the accompanying drawings.

Figure 2:
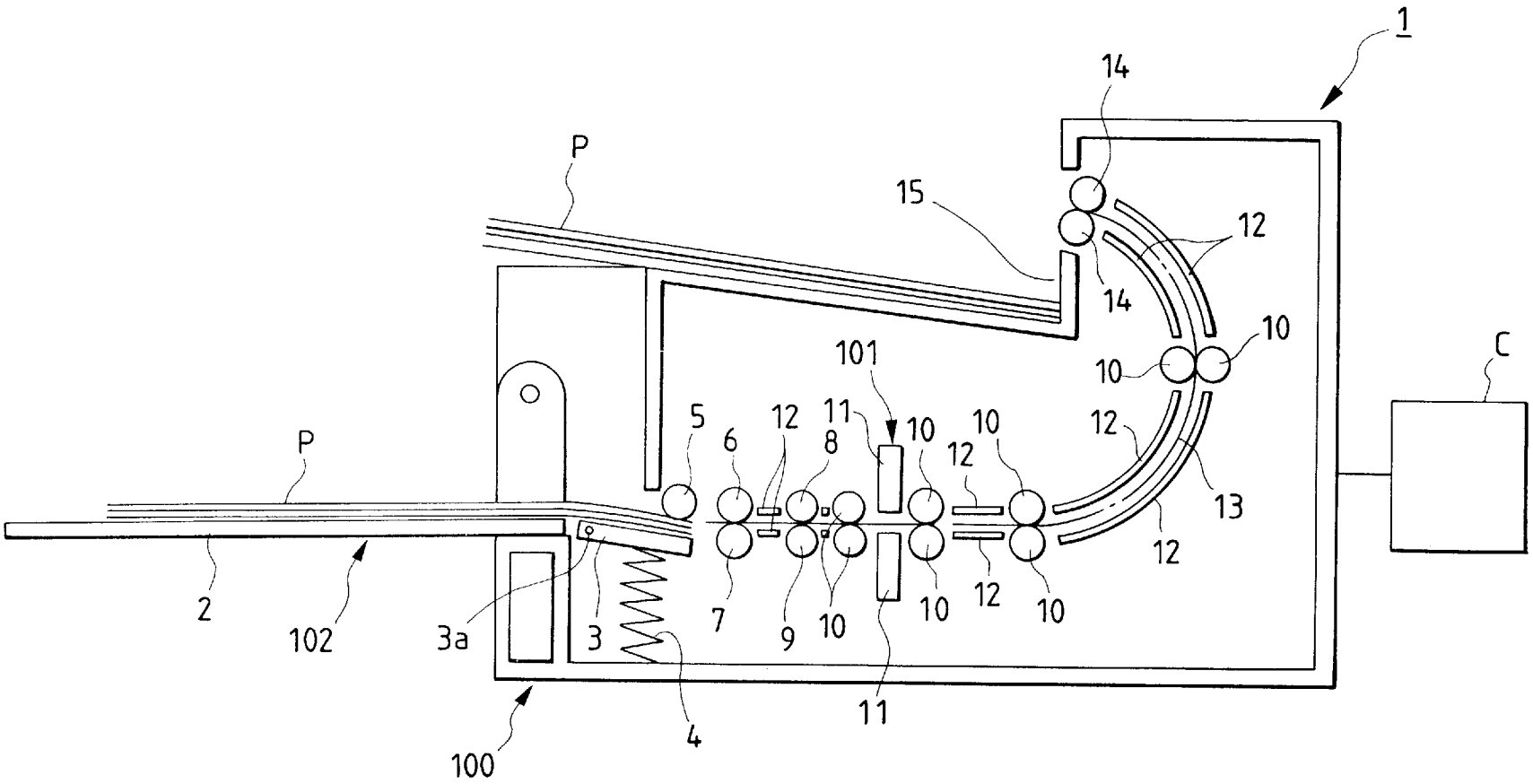
FIG. 2 is a schematic elevational sectional view of an image reading apparatus to which the sheet supplying apparatus according to the present invention is applied.

In FIG. 2 showing an image reading apparatus having a sheet supplying apparatus according to the present invention, an image reading apparatus 1 comprises a sheet supply portion 100 to which a sheet supplying apparatus according to the present invention for supplying a sheet original P as a sheet is applied, and a reading portion 101 for reading an image on the sheet original P supplied from the sheet supply portion 100.

The sheet supply portion 100 includes an original stacking portion (sheet supporting means) 102 on which the sheet originals P are stacked, a supply roller (sheet supply means) 5 for feeding out the sheet original(s) P into the reading apparatus by contacting with an uppermost sheet original P of the sheet original stack rested on the original stacking portion 102, a feed roller (normal rotation means) 6 disposed at a downstream side of the supply roller 5 and rotated in a normal direction with respect to a sheet original supplying direction, and a reverse rotation roller (reverse rotation means) 7 urged against the feed roller 6 from below and rotated in a reverse direction.

The original stacking portion 102 includes a vertically movable original stacking plate 3 for supporting tip ends (regarding a sheet original insertion direction) of the sheet originals P, and an original tray 2 extending from the original stacking plate 3 in a direction opposite to the sheet original insertion direction. The original stacking plate 3 can be rocked upwardly and downwardly around a shaft 3*a* positioned at a rear end (regarding the sheet original insertion direction) of the original stacking plate and is always biased upwardly by a spring 4 so that the tip end of the sheet original stack P is urged against the supply roller 5 regardless of the number of the sheets. When a plurality of sheet originals P are fed between the feed roller 6 and the reverse rotation roller 7 by the supply roller 5, only an uppermost sheet original P is advanced into a convey path 13 by a returning action of the reverse rotation roller 7.

A regist driven roller 9 which is urged against a regist drive roller 8 from the below is controlled by a clutch (not shown), and the sheet original P fed into the convey path 13 is sent to a plurality of pairs of convey rollers 10 disposed at a downstream side. The plurality of roller pairs 10 are arranged at a predetermined interval.

In the reading portion 101, two sensors 11 of close contact type are opposed to each other with the interposition of the convey path 13 so that image information on both surfaces of the sheet original P can be read by the sensors, respectively. After the images were read by the sensors of close contact type, the sheet original P is further conveyed along the convey path 13 by the downstream pairs of convey rollers 10 and convey guides 12. Then, the sheet original is discharged onto a discharge portion 15 out of the apparatus by means of a pair of discharge rollers 14. Such a series of operations are repeated until the all of sheet originals on sheet supply tray 2 are discharged onto the discharge portion.

The image reading apparatus mentioned above is connected to a control equipment C such as a personal computer so that the image reading apparatus is operated on the basis of various control signals from the control equipment C. The image information read from the sheet original by the image reading apparatus is sent to the control equipment C, where image treatments such as storing or memorizing of image are effected. Incidentally, the control equipment may be integrally incorporated into the image reading apparatus.

Next, a detailed construction of the sheet supply portion 100 according to the present invention will be fully explained with reference to FIGS. 1A and 1B.

Figure 4:
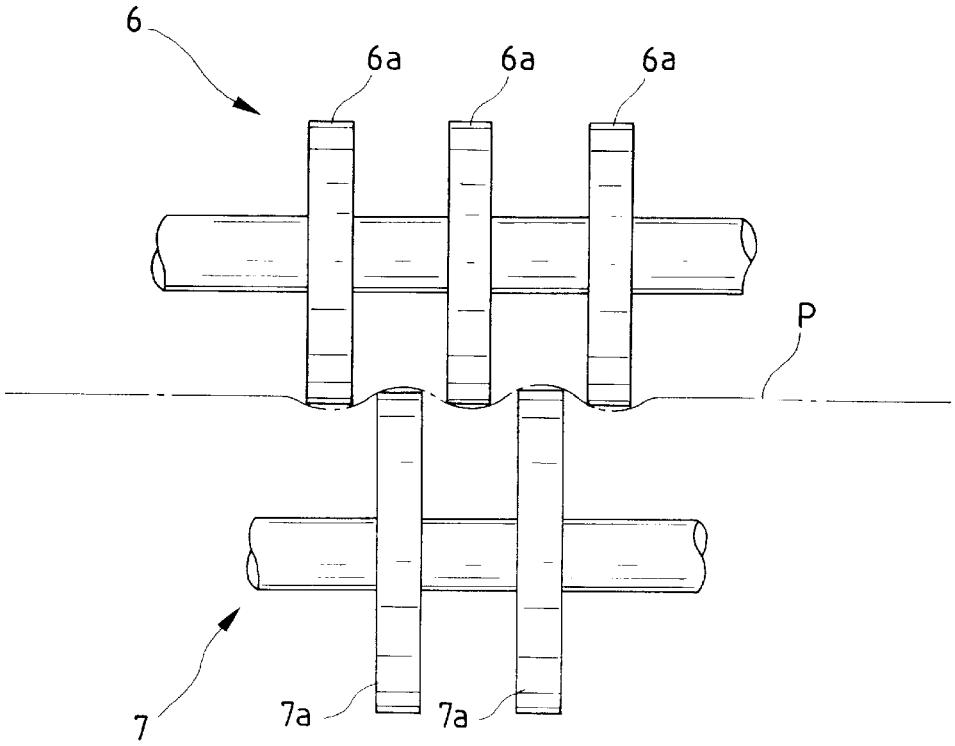
FIG. 4 is a view showing an example of a comb-shaped arrangement of a feed roller and a reverse rotation roller in the apparatus of FIGS. 1A and 1B.

The sheet supply portion 100 is provided with the sheet supply roller 5, feed roller 6 and reverse rotation roller 7. As shown in FIG. 4, the feed roller 6 and the reverse rotation roller 7 have a plurality of roller portions 6*a* and 7*a*, respectively, which are at a predetermined interval along their roller shafts (i.e., each has a so-called comb-shaped roller arrangement), and the roller portions 6*a*, 7*a* are staggered with each other. Incidentally, the present invention is not limited to such comb-shaped roller arrangements, but, the feed roller 6 may be urged against the reverse rotation roller 7 to rotate together.

Figure 1A:
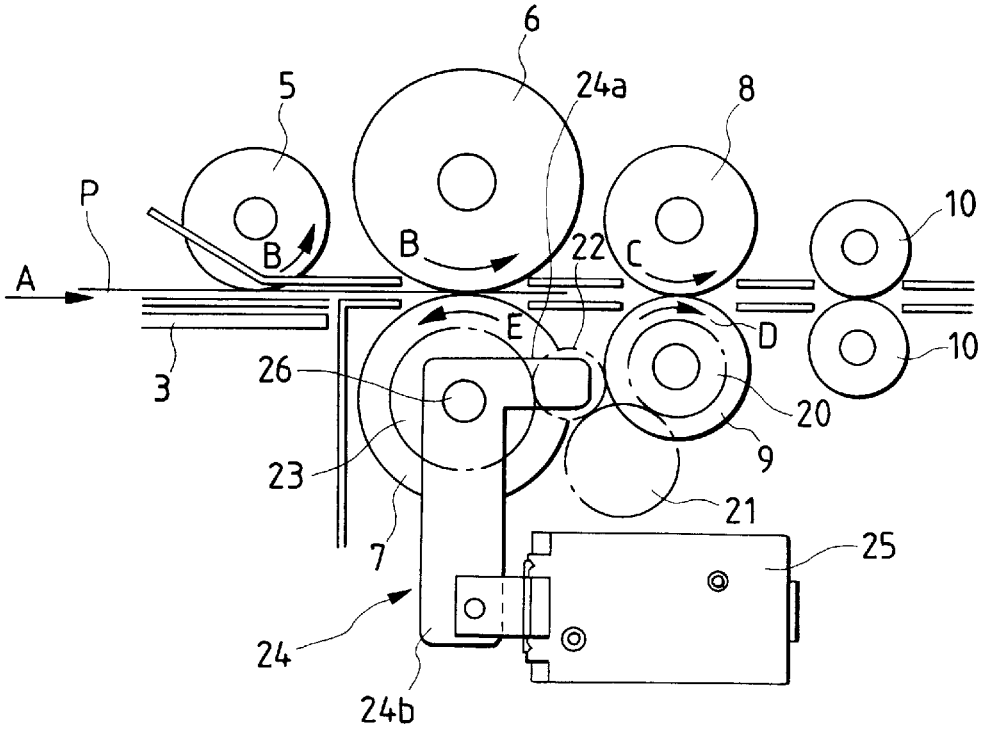
FIGS. 1A and 1B are schematic side views of a sheet supplying apparatus according to an embodiment of the present invention, when
Figure 1B:
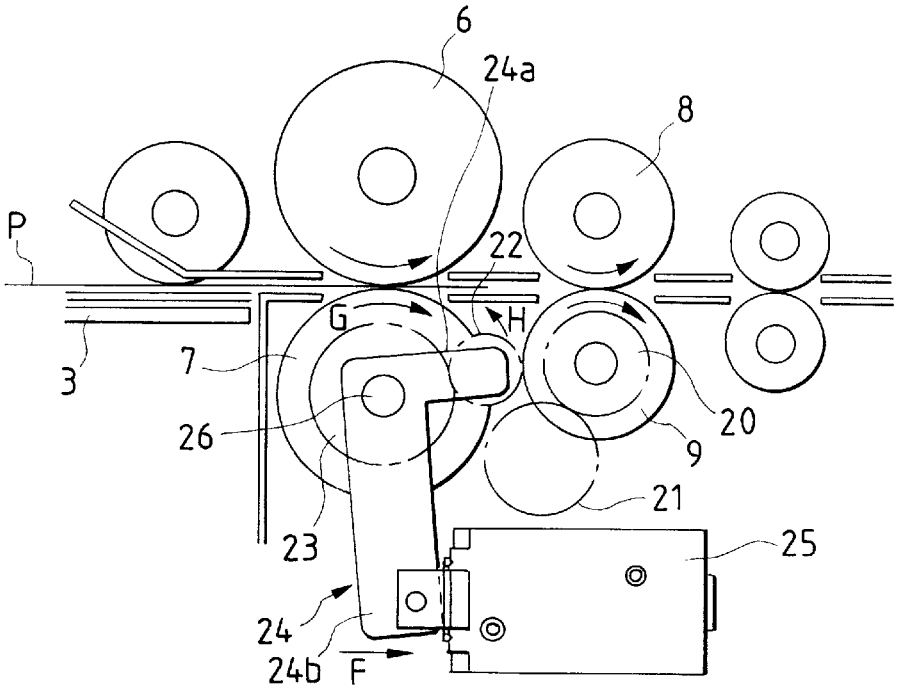

The supply roller 5 is rotated in an anti-clockwise direction (shown by the arrow B) in FIGS. 1A and 1B to feed the sheet original P in a direction shown by the arrow A, and the feed roller 6 is also rotated in the anti-clockwise direction in FIGS. 1A and 1B. Rotations of the supply roller 5 and the feed roller 6 are controlled by the same clutch (not shown) to supply a next sheet original P at a predetermined timing.

On the other hand, the regist drive roller 8 undergoes a driving force from a drive source (not shown) to rotate in an anti-clockwise direction (shown by the arrow C), and the regist driven roller 9 is urged against the regist drive roller 8 from the below by means of a spring (not shown) so that the regist driven roller is rotated in a clockwise direction (shown by the arrow D) by the rotation of the regist drive roller 8.

The rotation of the regist driven roller 9 is transmitted to the reverse rotation roller 7 through a gearing system comprised of first to fourth gears 20, 21, 22 and 23, so that the reverse rotation roller is rotated in an anti-clockwise direction (shown by the arrow E). The first gear 20 is rotated integrally with the regist drive roller 8, and the fourth gear 23 is rotated integrally with the reverse rotation roller 7. On the other hand, the second gear 21 is a driven gear which is meshed with the first gear 20 and is rotated at a given position. The third gear 22 is rotatably mounted on a rocking end of a lever 24 pivotally supported on a roller shaft 26 of the reverse rotation roller 7, so that the third gear can be rocked around the roller shaft 26 by the lever 24 while engaging with the fourth gear 23, thereby selectively engaging and disengaging with respect to the second gear 21. The lever 24 has a substantially L-shaped configuration including a first arm 24*a* and a second arm 24*b*, and a bent portion of "L" is pivotally supported on the roller shaft 26. The third gear 22 is rotatably attached to a rocking end of the first arm 24*a*. Further, a rocking end of the second arm 24*b* is connected to a plunger 25*a* of a solenoid 25. The lever 24 is always biased by a spring (not shown) toward a direction (clockwise direction) so that the third gear 22 is engaged by the second gear 21. In a condition that the solenoid 25 is inoperative, the third gear 22 is maintained to mesh with the second gear 21. When the solenoid 25 is energized, the lever 24 is rocked in the anti-clockwise direction to disengage the third gear 22 from the second gear 21.

Next, a manual sheet insertion operation for the sheet original P will be explained with reference to FIGS. 1A and 1B.

When a manual sheet insertion mode is set by a mode setting means incorporated into the control equipment C and a manual sheet insertion signal is emitted, the solenoid 25 is turned ON to pull the lever 24 in a direction shown by the arrow F, with the result that the third gear 22 is rocked around the roller shaft 26 in a direction shown by the arrow H to be disengaged from the second gear 21, thereby preventing the transmission of the rotation of the regist driven roller 9 to the reverse rotation roller 8. In this condition, when the sheet original P is supplied, since the reverse rotation roller 8 is rotated freely, the reverse rotation roller is driven by the advancing movement of the sheet original P to be rotated in a direction shown by the arrow G.

Accordingly, even if the sheet original P is a thin sheet having poor resiliency, the sheet original P is positively supplied while being pinched between the feed roller 6 and the reverse rotation roller 7 with predetermined pressure, thereby smoothly conveying the sheet original without forming any wrinkle. On the other hand, if the sheet original P is a thick sheet having strong resiliency, since the sheet original is pinched between the feed roller 6 and the reverse rotation roller 7 with the predetermined pressure, the adequate conveying force is applied to the sheet original, thereby preventing poor sheet supply.

In the illustrated embodiment, a drive force transmission switching means is constituted by the first to fourth gears 20 to 23, lever 24 and solenoid 25. With this arrangement, since the switching of the drive force transmission can be effected only by performing the connection or disconnection between the third gear 22 meshed with the fourth gear 23 of the reverse rotation roller 8 and the second gear 21 meshed with the first gear 20 of the downstream regist driven roller 9, the switching of the drive force transmission can be effected by a simple mechanism within a small space.

Figure 3A:
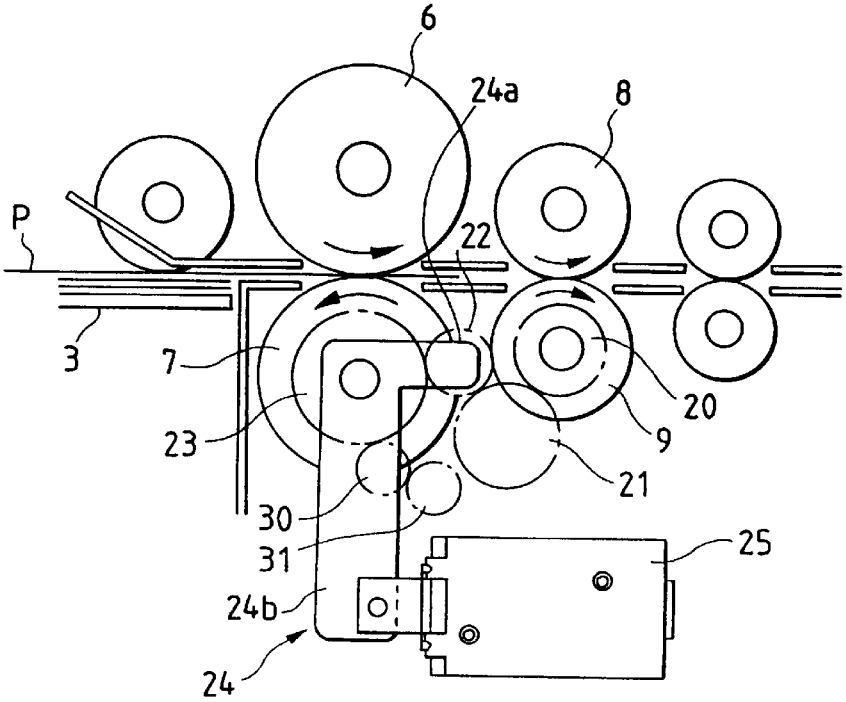
FIGS. 3A and 3B are schematic side views of a sheet supplying apparatus according to another embodiment of the present invention in which gears are added to the apparatus of FIGS. 1A and 1B, where
Figure 3B:
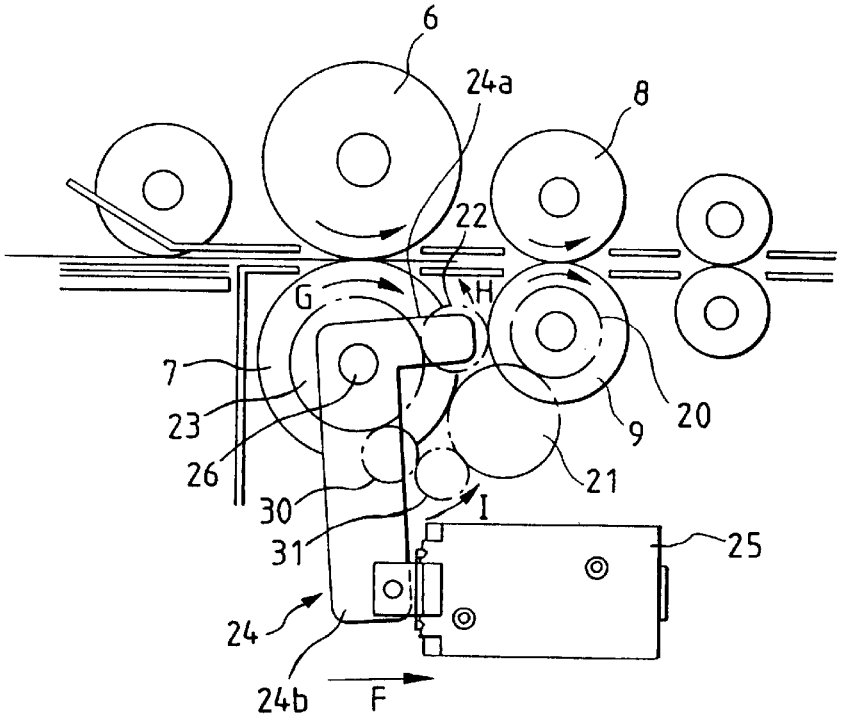

Next, another embodiment wherein gears 30, 31 shown in FIGS. 3A and 3B are added to the above-mentioned sheet supplying apparatus will be explained.

A fifth gear 30 rockable around the roller shaft 26 while engaging by the fourth gear 23 is rotatably mounted on an intermediate portion of the second arm 24*b*, and a sixth gear 31 meshed with the fifth gear 30 can be rocked together with the second arm 24*b*. Unlike to the third gear 22, the sixth gear 31 is spaced apart from the second gear 21 when the solenoid 25 is in an OFF condition. When the solenoid 25 is turned ON, the sixth gear is engaged by the second gear 21.

FIG. 3A is a sectional view showing a continuous sheet supply mode in which the third gear 22 is engaged by the second gear 21 to transmit the reverse rotation driving force to the reverse rotation roller 7 and the sixth gear 31 is disengaged from the second gear 21.

Next, a manual sheet insertion mode will be explained with reference to FIG. 3B. As is in the first embodiment, when the manual sheet insertion signal is emitted, the solenoid 25 is turned ON to pull the lever 24 in the direction F. Consequently, the third gear 22 is rocked around the roller shaft 26 in the direction H to be disengaged from the second gear 21. At the same time, the gears 30, 31 are connected to the second gear 21, with the result that rotational force (direction G) of the regist driven roller 9 is transmitted to the reverse rotation roller 7.

In this way, by adding the gears 30, 31, since the sheet conveying force is further increased, even if the thick sheet having strong resiliency is used, the poor sheet supply can be avoided. Further, if the thin sheet having poor resiliency is used, the formation of any wrinkle can be prevented. In addition, the reverse rotation roller can be driven only by connecting it to the immediate downstream first gear 20 of the regist driven roller 9, the driving of the reverse rotation can be effected by a simple mechanism within a small space.

Incidentally, in the above embodiments, while an example that the sheet supplying apparatus according to the present invention is applied to the sheet original supply portion of the image reading apparatus was explained, the present invention can also be applied to a sheet supply portion of an image reading apparatus having a recording portion for recording an image on the sheet.

Figure 5:
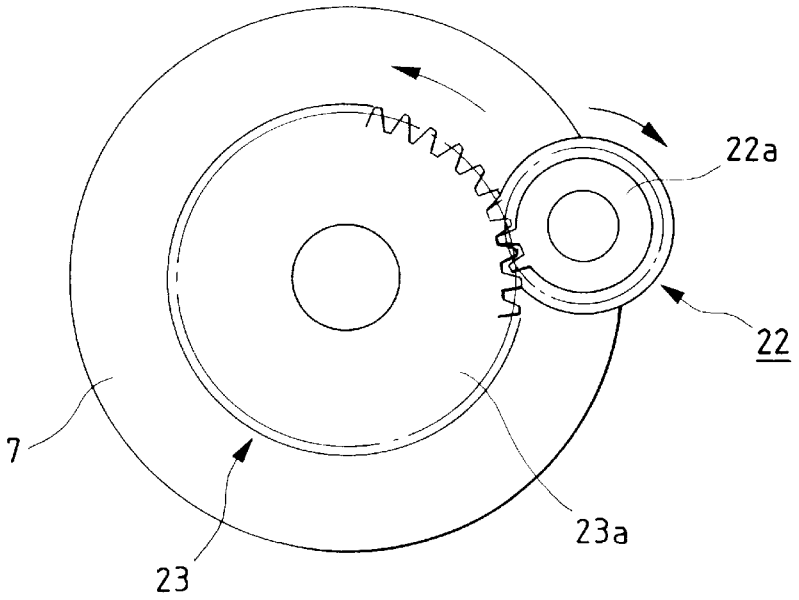
FIG. 5 is a side view showing a relation between an intermittent gear and a gear rotated together with the reverse rotation roller, looked at from one side of the gears.
Figure 6:
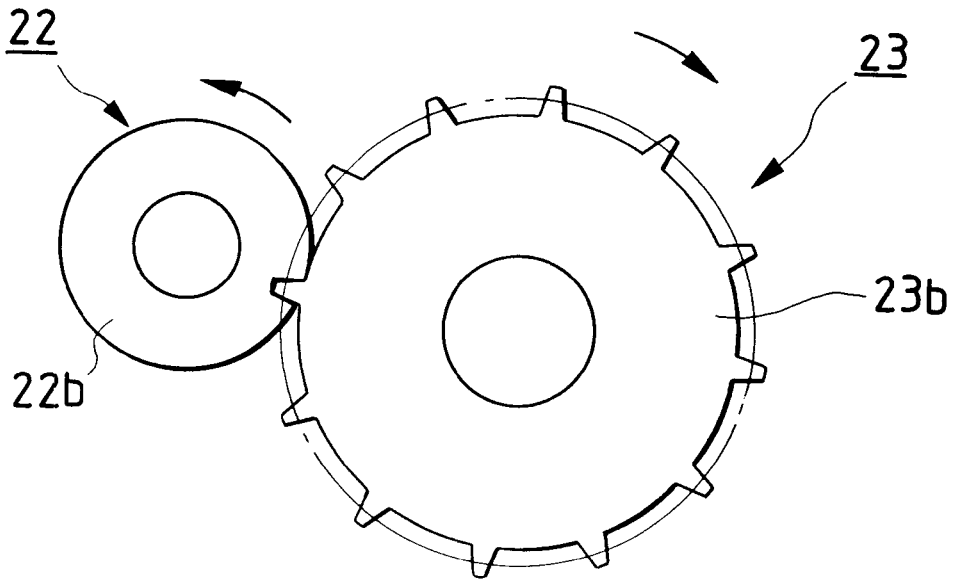
FIGS. 6 and 7 are side views showing the relation between the intermittent gear and the gear rotated together with the reverse rotation roller, looked at from the other side of the gears.
Figure 7:
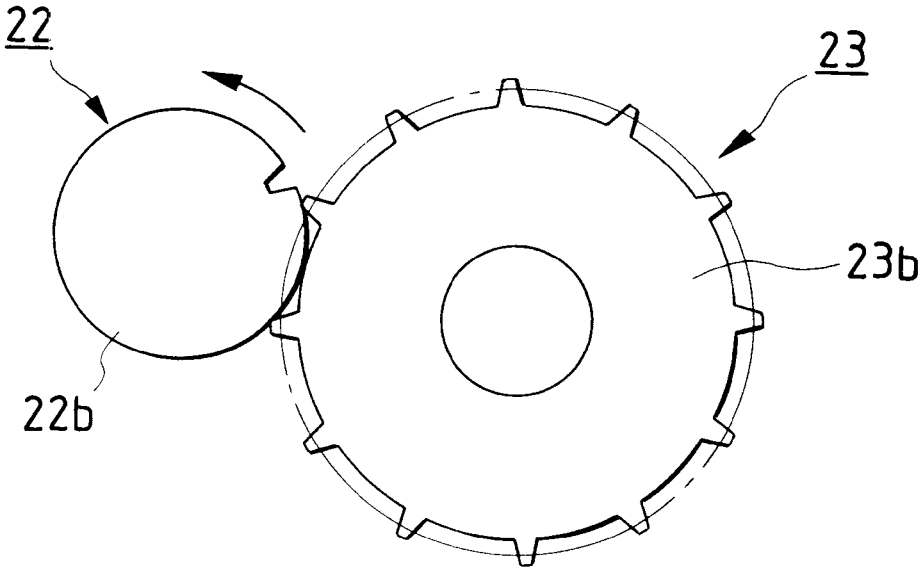

Incidentally, the reverse rotation roller may be rotated intermittently. More particularly, by constituting one of the gears 20 to 23 as an intermittent gear having one or several gear teeth, the reverse rotation roller 7 can be rotated intermittently. With an arrangement as shown in FIGS. 5 to 7, the third gear 22 among the gears 20 to 23 is constituted by an intermittent gear having two gear teeth. Now, a relation between gear 22 (as the intermittent gear) and the gear 23 rotated integrally with the reverse rotation roller 7 will be explained. FIG. 5 is a side view of such gears looked at from one side thereof, and FIGS. 6 and 7 are side views of such gears looked at from the other side.

As shown in FIGS. 5 and 6, the gear 23 has two gear portions 23*a*, 23*b* which are integral with each other, and, the gear 22 as the intermittent gear has a gear portion 22*a* having two teeth capable of engaging by the gear portion 23*a* of the gear 23, and a gear portion 22*b* having a groove capable of engaging by the gear portion 23*b* of the gear 23, which gear portions 22*a*, 22*b* are integral with each other. The two teeth of the gear portion 22*a* capable of engaging by the gear portion 23*a* are located at the same position as the groove of the gear portion 22*b* capable of engaging by the gear portion 23*b*. With this arrangement, when the regist driven roller 9 is being rotated, the gear 22 as the intermittent gear is always rotated; whereas, the gear 23 is rotated by an amount corresponding to the teeth of the gear 22 only when it is engaged by the gear 22 as the intermittent gear. Otherwise, as shown in FIG. 7, since an outer periphery of the gear portion 22*b* enters into a groove between two adjacent teeth of the gear portion 23*b* to prevent the rotation of the gear 23, when the gear portion 22*a* is not engaged by the gear portion 23*a*, the reverse rotation roller 7 cannot be rotated in the sheet original supplying direction to maintain the reverse rotation roller 7 in a stopped condition.

Accordingly, when the sheet original P enters into a nip between the feed roller 6 and the reverse rotation roller 7, even if a tip end of the sheet original P firstly abuts against the reverse rotation roller 7, since the reverse rotation roller 7 is stopped, the sheet original P can easily enter into the nip between the rollers 6 and 7, thereby preventing the poor sheet supply. This arrangement is particularly effective when the conveying force of the feed roller 6 is decreased due to wear or the like.

Further, as mentioned above, since the transmission of the driving force to the reverse rotation roller 7 is effected by the gear train forming the drive force transmitting mechanism for transmitting the driving force from the immediate downstream regist driven roller 9 to the reverse rotation roller and one of the gears included in the gear train is constituted by the intermittent gear having one or several gear teeth (gear 22 in the illustrated embodiment), the intermittent rotation of the reverse rotation roller can be achieved by the simple mechanism within the small space.

Further, since the reverse rotation roller 7 is rotated intermittently (more specifically, the reverse rotation roller 7 is rotated by the amount corresponding to the teeth of the gear 22 as the intermittent gear), when the sheet originals P enter into the nip between the rollers 6 and 7, the sheet originals P are separated by the feed roller 6 rotated in the normal direction and the reverse rotation roller 7 intermittently rotated in the reverse direction, thereby providing good sheet supply and preventing the double-feed of sheet originals P.

What is claimed is:

1. A sheet supplying apparatus comprising:

sheet supporting means for supporting a sheet;

sheet supply means for feeding out the sheet supported by said sheet supporting means;

separation means disposed downstream of said sheet supply means in a sheet supplying direction and having a normal rotation member rotated in a sheet supplying direction and a reverse rotation member rotated in a reverse direction opposite thereto to separate the sheets fed out by said sheet supply means one by one; and drive force transmission switching means for transmitting a rotational force to said reverse rotation member to rotate said reverse rotation member in the reverse direction in a continuous supply mode in which the sheets supported in said sheet supporting means are continuously fed out by said sheet supply means, and for stopping the transmission of the rotational force to said reverse rotation member in a manual sheet insertion mode in which a single sheet manually inserted is fed toward said separation means.

2. A sheet supplying apparatus according to claim 1, further comprising a convey means disposed downstream of said separation means in the sheet supplying direction to convey the sheet separated by said separation means, and a drive force transmitting means for transmitting rotation of said convey means to said reverse rotation member, wherein said drive force transmission switching means is disposed in said drive force transmitting means.

3. A sheet supplying apparatus according to claim 2, wherein said drive force transmitting means has a gear train including a plurality of gears, and said drive force transmission switching means can prevent the transmission of the rotational force by disengaging at least two gears of said gear train from each other.

4. A sheet supplying apparatus according to claim 3, wherein said drive force transmission switching means has a solenoid to effect the disengaging of at least two gears of said gear train from each other.

5. A sheet supplying apparatus according to claim 2, wherein said drive force transmitting means includes an intermittent rotation transmitting means for intermittently rotating said reverse rotation member in the reverse direction.

6. A sheet supplying apparatus according to claim 5, wherein said intermittent rotation transmitting means transmits the rotation intermittently by a gear having a non-toothed portion.

7. A sheet supplying apparatus according to claim 1, further comprising a normal rotation transmitting means for transmitting rotation to said reverse rotation member to rotate said reverse rotation member in the sheet supplying direction when the transmission of rotation for rotating said reverse rotation member in the reverse direction is interrupted by said drive force transmission switching means.

8. A sheet supplying apparatus according to claim 1, further comprising a mode setting means for setting the continuous supply mode in which the sheets supported by said sheet supporting means are continuously fed out, and the manual sheet insertion mode in which a single sheet is inserted into said separation means, wherein said drive force transmission switching means is operated on the basis of the setting effected by said mode setting means.

9. A sheet supplying apparatus according to claim 1, wherein each of said normal rotation member and said reverse rotation member have roller portions disposed at a predetermined interval along their rotation axes, respectively, and said roller portion of said normal rotation member and said reverse rotation member are staggered to each other.

10. A sheet supplying apparatus comprising:

sheet supporting means for supporting a sheet;

sheet supply means for feeding out the sheet supported by said sheet supporting means;

separation means disposed downstream of said sheet supply means in a sheet supplying direction and having a normal rotation member rotated in a sheet supplying direction and a reverse rotation member rotated in a reverse direction opposite thereto to separate the sheets fed out by said sheet supply means one by one; and drive force transmission switching means for transmitting a rotational force to said reverse rotation member to rotate said reverse rotation member in the reverse direction in a continuous supply mode in which the sheets supported in said sheet supporting means are continuously fed out by said sheet supply means, and for transmitting a rotational force to said reverse rotation member to rotate said reverse rotation member in the sheet supplying direction in a manual sheet insertion mode in which a single sheet manually inserted is fed toward said separation means.

11. A sheet supplying apparatus according to claim 10, further comprising a drive force transmitting means for effecting transmission to said reverse rotation member, wherein said drive force transmission switching means is disposed in said drive force transmitting means.

12. A sheet supplying apparatus according to claim 11, wherein said drive force transmitting means has a gear train including a plurality of gears, and said drive force transmission switching means has a support arm for pivotally supporting a first gear and a second gear, said first gear being engaged with a driven gear provided on said reverse rotation member and said second gear being engaged with a third gear which is engaged with said driven gear, and operation means for rocking said support arm to selectively engage said first or second gear with a driven gear which is transmitted the rotational force, wherein said reverse rotation member is rotated in the reverse direction when said first gear is engaged with said driven gear and is rotated in the sheet supplying direction when said second gear is engaged with said driven gear.

13. A sheet supplying apparatus according to claim 12, wherein said operation means comprises a solenoid.

14. A sheet supplying apparatus according to claim 11, further comprising convey means disposed downstream of said separation means in the sheet supplying direction to convey the sheet separated by said separation means, wherein said drive force transmitting means transmits rotation of said convey means to said reverse rotation member.

15. An image reading apparatus comprising:

sheet supporting means for supporting a sheet;

sheet supply means for feeding out the sheet supported by said sheet supporting means;

separation means disposed downstream of said sheet supply means in a sheet supplying direction and having a normal rotation member rotated in a sheet supplying direction and a reverse rotation member rotated in a reverse direction opposite thereto to separate the sheets fed out by said sheet supply means one by one;

drive force transmission switching means for transmitting a rotational force to said reverse rotation member to rotate said reverse rotation member in the reverse direction in a continuous supply mode in which the sheets supported in said sheet supporting means are continuously fed out by said sheet supply means, and for stopping the transmission of the rotational force to said reverse rotation member in a manual sheet insertion mode in which a single sheet manually inserted is fed toward said separation means; and reading means for reading an image formed on the sheet separated by said separation means.

16. An image reading apparatus comprising:

sheet supporting means for supporting a sheet;

sheet supply means for feeding out the sheet supported by said sheet supporting means;

separation means disposed downstream of said sheet supply means in a sheet supplying direction and having a normal rotation member rotated in a sheet supplying direction and a reverse rotation member rotated in a reverse direction opposite thereto to separate the sheets fed out by said sheet supply means one by one;

drive force transmission switching means for transmitting a rotational force to said reverse rotation member to rotate said reverse rotation member in the reverse direction in a continuous supply mode in which the sheets supported in said sheet supporting means are continuously fed out by said sheet supply means, and for transmitting a rotational force to said reverse rotation member to rotate said reverse rotation member in the sheet supplying direction in a manual sheet insertion mode in which a single sheet manually inserted is fed toward said separation means; and a reading means for reading an image on the sheet separated by said separation means.

* * * * *

UNITED STATES PATENT AND TRADEMARK OFFICE

CERTIFICATE OF CORRECTION

PATENT NO. : 5,901,951

DATED : May 11, 1999

INVENTOR(S) : TAKESHI YAMAGUCHI

It is certified that error appears in the above-identified patent and that said Letters Patent is hereby corrected as shown below:

COVER PAGE AT ITEM [56] FOREIGN PATENT DOCUMENTS, "357090337" should read --57-090337--, "0167836" should read --60-167836--, and "0139842" should read --63-139842--.

COLUMN 1,
Line 40, "winkles" should read --wrinkles--.

Signed and Sealed this

Thirtieth Day of May, 2000

*Attest:*

Q. TODD DICKINSON

*Attesting Officer*

*Director of Patents and Trademarks*